US008761640B2

(12) United States Patent
Takayama

(10) Patent No.: US 8,761,640 B2
(45) Date of Patent: Jun. 24, 2014

(54) IMAGE FORMING APPARATUS

(75) Inventor: Akinori Takayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 590 days.

(21) Appl. No.: 12/909,081

(22) Filed: Oct. 21, 2010

(65) Prior Publication Data

US 2011/0097111 A1 Apr. 28, 2011

(30) Foreign Application Priority Data

Oct. 28, 2009 (JP) ..... 2009-248063

(51) Int. Cl.
*G03G 21/00* (2006.01)

(52) U.S. Cl.
USPC ..... 399/124; 399/123

(58) Field of Classification Search
USPC ..... 399/107, 110, 123, 124, 125
See application file for complete search history.

(56) References Cited

U.S. PATENT DOCUMENTS

| | | | | |
|---|---|---|---|---|
| 5,428,426 | A | 6/1995 | Inomata et al. | |
| 6,035,158 | A | 3/2000 | Asakura et al. | |
| 6,571,074 | B2 * | 5/2003 | Suzuki et al. | 399/124 |
| 7,162,182 | B2 * | 1/2007 | Tonges et al. | 399/110 |

FOREIGN PATENT DOCUMENTS

| | | | |
|---|---|---|---|
| JP | 4-073775 | A | 3/1992 |
| JP | 4-335368 | A | 11/1992 |
| JP | 10-3236 | A | 1/1998 |
| JP | 11-174863 | A | 7/1999 |
| JP | 2003-280489 | A | 10/2003 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a main assembly; a door openable relative to the main assembly; an image bearing member for bearing a toner image; a cleaning member for removing toner remaining on the image bearing member; a transfer member for transferring the toner image onto a sheet; a fixing member for fixing the toner image, transferred by the transfer member, on the sheet; a discharging member for discharging the sheet, on which the toner image is fixed by the fixing member, from the main assembly. The sheet remaining in the main assembly without being discharged by the discharging member is capable of being removed from a space formed by opening the door. The image forming apparatus further includes a spacer unit capable of moving the cleaning member toward and away from the image bearing member. The spacer unit brings the cleaning member into contact with the image bearing member in a state in which the door is closed and image formation is effected, and moves the cleaning member away from the image bearing member in interrelation with an opening operation of the door.

9 Claims, 18 Drawing Sheets

IMAGE FORMING APPARATUS

FIELD OF THE INVENTION AND RELATED ART

The present invention relates to an image forming apparatus of an electrophotographic type.

Examples of the image forming apparatus of the electrophotographic type may include an electrophotographic copying machine, an electrophotographic printer (such as a laser beam printer or an LED (light emitting diodes) printer), and the like. Further, a cartridge is prepared by integrally assembling process means such as a toner image forming portion and is detachably mountable to an image forming apparatus main assembly. Thus, the cartridge can be mounted to and dismounted from the image forming apparatus main assembly by a user himself (herself), so that maintenance of the main assembly can be easily performed.

According to Japanese Laid-Open Patent Application (JP-A) Hei 4-335368, in an image forming apparatus capable of forming a color image, an intermediary transfer member is constituted so as to be rotated by a driving source on an apparatus main assembly side to permit rotational drive of a photosensitive drum through the intermediary transfer member. As a result, during mounting of a process cartridge in the apparatus main assembly, an image bearing member is only required to be positioned with respect to only the intermediary transfer member with accuracy, so that mounting and dismounting of the process cartridge with respect to the apparatus main assembly and the positioning can be facilitated.

However, in JP-A Hei 4-335368, the intermediary transfer member, a photosensitive unit, a developing cartridge and a scanner unit are required to be arranged in a predetermined order correspondingly to an image forming operation. For this reason, in order to mount and dismount the developing cartridge or the process cartridge integrally including the photosensitive unit and the developing cartridge with respect to the apparatus main assembly, the scanner unit is required to be retracted.

In order to solve this problem, it can be considered to use a method in which the photosensitive unit or the developing cartridge is moved by rotation or the like from an attitude during image formation to a position in which the developing unit is directed to an opening and then the developing unit, the intermediary transfer member or the photosensitive unit is exchanged.

However, in this case, the following problem arises. That is, during the image formation, a transfer member for transferring the toner image from the intermediary transfer member surface onto a sheet such as paper or a cleaning unit for removing toner remaining on the intermediary transfer member surface contacts the intermediary transfer member. Further, the cleaning unit is disposed between the transfer member and a photosensitive member for effecting subsequent image formation. Particularly, in the case where the image forming apparatus main assembly is downsized, it is desirable that a distance between the transfer member and the cleaning unit is small. In such a case, jam such that the sheet on which the toner image has been transferred is wound about the intermediary transfer member and remains inside the apparatus main assembly without being separated from the intermediary transfer member can occur. In order to remove the sheet jammed between the intermediary transfer member and the cleaning unit. There is a need to move the photosensitive unit and the developing cartridge and then to perform a dismounting operation of the intermediary transfer member from the image forming apparatus main assembly. For this reason, a maintenance operation performed by a user for restoring the image forming apparatus to an image formable state was complicated.

Further, when the mounting of the intermediary transfer member is performed during exchange of the intermediary transfer member while the cleaning unit contacts the intermediary transfer member, the cleaning unit is pressed against the intermediary transfer member with contact pressure which is not less than pressure necessary for the cleaning. Thus, a problem such that the intermediary transfer member surface was damaged by rubbing between the cleaning unit and the intermediary transfer member or such that the cleaning unit resulted in inconvenience by the rubbing with respect to an opposite direction to a normal rubbing direction was caused to occur.

SUMMARY OF THE INVENTION

A principal object of the present invention is to provide an image forming apparatus capable of eliminating the need for mounting and demounting a developing unit or an intermediary transfer unit even when jam such that a sheet is jammed between a cleaning member and an image bearing member or an intermediary transfer member and remains in the image forming apparatus occurs.

According to an aspect of the present invention, there is provided an image forming apparatus comprising:

a main assembly;

a door openable relative to the main assembly;

an image bearing member for bearing a toner image;

a cleaning member for removing toner remaining on the image bearing member;

a transfer member for transferring the toner image onto a sheet;

a fixing member for fixing the toner image, transferred by the transfer member, on the sheet;

a discharging member for discharging the sheet, on which the toner image is fixed by the fixing member, from the main assembly, wherein the sheet remaining in the main assembly without being discharged by the discharging member is capable of being removed from a space formed by opening the door, and a spacer unit capable of moving the cleaning member toward and away from the image bearing member, wherein the spacer unit brings the cleaning member into contact to the image bearing member in a state in which the door is closed and image formation is effected, and moves the cleaning member away from the image bearing member in interrelation with an opening operation of the door.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. However, dimensions, materials, shapes and relative configurations of constituent parts described in the following embodiments can be appropriately changed depending on constitutions and various conditions of an image forming apparatus to which the present invention is applied.

First Embodiment

Figure 1:
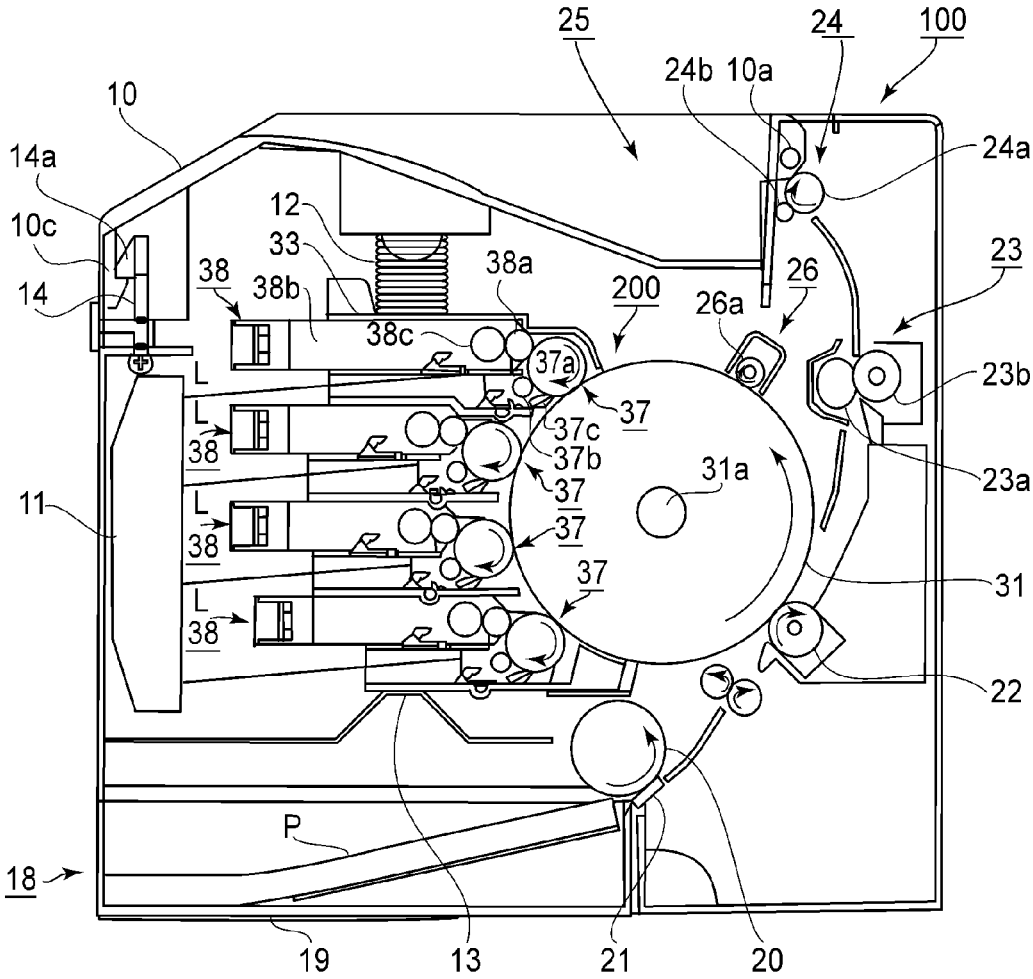
FIG. 1 is a sectional view of an outer appearance of an image forming apparatus according to First Embodiment of the present invention.

A schematic general structure of an image forming apparatus 100 will be described with reference to the drawings. FIG. 1 is a perspective view of an outer appearance of the image forming apparatus 100 of the present invention. The image forming apparatus 100 is a four-color based laser beam printer. The image forming apparatus 100 effects image formation on a sheet P such as paper on the basis of an electrical image signal input from an external host device (not shown) such as a personal computer, an image reader, or a remote facsimile machine.

In the following description, with respect to the image forming apparatus 100 (also referred to as an apparatus main assembly 100), a front side (direction) is a side (direction) on which a (sheet) feeding cassette 19 is pulled out. A rear side (direction) is an opposite side (direction) to the front side (direction). An upper side (direction) is a side (direction) on which a mount cover 10 which is a door covering an opening through which the sheet P remaining in the apparatus main assembly 100 can be removed is opened. The door is openable with respect to the apparatus main assembly, a front-rear direction is a (front) direction from the rear side toward the front side of the apparatus main assembly 100 and a (rear) direction opposite from the front direction. Left and right are those as seen from the front side of the apparatus main assembly 100. A left-right direction is a (left) direction from right toward left and a (right) direction opposite from the left direction.

Figure 2:
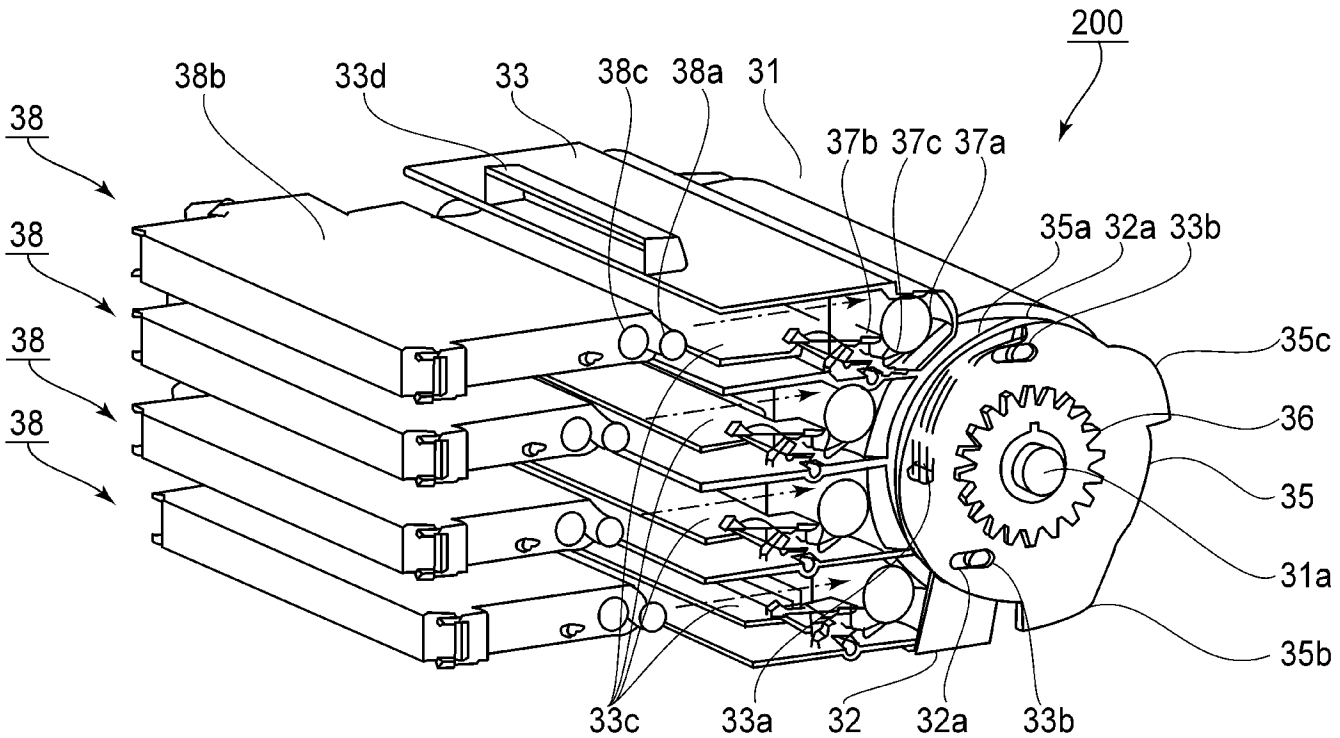
FIG. 2 is a perspective view of an outer appearance of developing cartridges and an image forming unit to be mounted in the image forming apparatus according to First Embodiment of the present invention.

Inside the apparatus main assembly 100, the image forming unit 200 is driven. FIG. 2 is a perspective view of an image forming unit 200 and developing cartridges 38. The image forming unit 200 includes photosensitive units 37 each including a photosensitive drum (image bearing member) 37*a* on which a toner image is to be formed, and an intermediary transfer unit (intermediary transfer member) 31 which can be an image bearing member onto which the toner image is transferred from the photosensitive drum 37*a* in contact with the surface of the photosensitive drum 38*a*. Further, the image forming unit 200 is constituted by a sub-frame 32 rotatably supported about the intermediary transfer unit 31 and a cartridge tray 33 supported by the sub-frame 32 so as to be movable in a front-rear direction by a predetermined distance. Further, the image forming unit 200 includes a cam plate 35 for moving the cartridge tray 33 and a gear for driving the cam plate 35 on each of left and right sides of the sub-frame 32. The cam plate 35 and the gear 36 are rotatably and integrally supported by a center shaft (axis) 31*a* of the intermediary transfer unit 31. The cartridge tray 33 includes a round boss 33*a* engaged with a groove portion 35*a* provided on the cam plate 35. The cartridge tray 33 also includes two elongated circular bosses 33*b*. When the elongated circular bosses 33*b* are engaged with groove portions 32*a* of the sub-frame 32, the cartridge tray 33 is supported by the sub-frame 32 so as to be movable in the front-rear direction by the predetermined distance.

Inside the cartridge tray 33, the photosensitive units 37 are disposed with a predetermined interval. Each of the photosensitive units 37 includes the photosensitive drum 37*a* for carrying the toner image of toner (developer), a charging roller 37*b* as a process means acting on the photosensitive drum 37*a*, and a cleaning member 37*c* for removing the developer remaining on the surface of the photosensitive drum 37*a*.

A plurality of developing cartridges 38 each for supplying the developer to an associated photosensitive unit 37*a* is inserted through an opening 33*c* and is connected to the image forming unit 200. Each of the developing cartridges 38 includes a developing roller 38*a* for supplying the toner (developer) to the photosensitive drum 37*a*, a developing device 38*b* for accommodating the toner (developer), and a feeding roller 38*c* for feeding the developer from the developing device 38*b* to the developing roller 38*a*. The developing cartridges 38 constituting a single or a plurality of developer holding units can be mounted in or dismounted from the apparatus main assembly 100 and contact the intermediary transfer unit 31 during the image formation.

The toner image formed by the developing cartridge 38 and the photosensitive unit 37 is primary-transferred onto the intermediary transfer unit 31 by a primary transfer member and then is secondary-transferred onto the sheet P by a secondary transfer member. At a periphery of the intermediary transfer unit 31, a secondary transfer roller 22 as the secondary transfer member is provided. The secondary transfer roller 22 is movable toward and away from the intermediary transfer unit 31. Further, the secondary transfer roller 22 transfers the toner image from the surface of the intermediary transfer unit (intermediary transfer member) 31 onto the sheet P. Further, at the periphery of the intermediary transfer unit 31, a cleaning unit (cleaning member) 26 for removing the toner image which remains on the surface of the intermediary transfer unit 31 without being secondary-transferred is provided. The cleaning unit 26 is disposed on a downstream side of the secondary transfer roller 22 and on an upstream side of the photosensitive unit 37 with respect to the rotational direction of the intermediary transfer unit (intermediary transfer member) 31.

At a front portion of the developing cartridge 38, a laser scanner unit 11 is disposed. The laser scanner unit 11 outputs laser light L modulated correspondingly to image information for each color input from the external host device, so that each of the photosensitive drums 32*a* is subjected to scanning exposure.

At a lower portion of the image forming unit 200, a (sheet) feeding unit 18 is disposed. The feeding unit 18 includes the feeding cassette 19, a feeding roller 20, a separation pad 21, and the like. The feeding cassette 19 is a type in which it can be freely pulled out from the front side and inserted into the apparatus main assembly 100.

At a rear upper portion inside the apparatus main assembly (image forming apparatus) 100, a fixing member 23 for fixing on the sheet P the toner image transferred by the transfer member, and a discharging roller pair 24 as a discharging member are disposed. An upper surface of the apparatus main assembly 100 constitutes a discharging tray 25. The fixing member 23 is of the type using a fixing film unit 23*a* and a pressing roller 23*b*. The discharging roller pair 24 includes discharging rollers 24*a* and 24*b*.

Each of the photosensitive unit 37 in a state in which it is mounted at a mounting position inside the apparatus main assembly 100 has a drive input portion, for the photosensitive unit 37, connected to a drive output portion of the apparatus main assembly 100. Further, to electrical contacts of the photosensitive unit 37, an energization system of the apparatus main assembly 100 is electrically connected.

An operation for forming a full-color image is as follows. The photosensitive drum 37*a* of each of the photosensitive units 37 is rotationally driven in a clockwise direction indicated by an arrow in FIG. 1 at a predetermined control speed. The intermediary transfer unit 31 is also rotationally driven in a counterclockwise direction (following the rotation of the photosensitive drum 37*a*) indicated by an arrow in FIG. 1 at a speed corresponding to the speed of the photosensitive drum 37*a*. The laser scanner unit 11 is also driven. In synchronism with this drive, in each of the photosensitive units 37, the charging roller 37*b* uniformly charges the surface of the photosensitive drum 37*a* to a predetermined-polarity and a predetermined potential. The laser scanner unit 11 scans and exposes the surface of the photosensitive drum 37*a* with the laser light L which has been modulated depending on an image signal for each color. As a result, on the surface of each photosensitive drum 37*a*, an electrostatic latent image for an associated color is formed. The thus formed electrostatic latent image is developed into the toner image by the developing cartridge 38.

By an electrophotographic image forming process operation as described above, on a first photosensitive drum 37*a*, a yellow (Y) toner image corresponding to a yellow component of the full-color image is formed and then the toner image is primary-transferred onto the intermediary transfer unit (intermediary transfer member) 31.

On a second photosensitive drum 37*a*, a magenta (M) toner image corresponding to a magenta component of the full-color image is formed and then the toner image is primary-transferred superposedly onto the Y toner image which has already been transferred onto the intermediary transfer unit 31.

On a third photosensitive drum 37*a*, a cyan (Y) toner image corresponding to a cyan component of the full-color image is formed and then the toner image is primary-transferred onto the Y toner image and the M toner image which have already been transferred onto the intermediary transfer unit 31.

On a fourth photosensitive drum 37*a*, a black (K) toner image corresponding to a black component of the full-color image is formed and then the toner image is primary-transferred superposedly onto the Y toner image, the M toner image and the C toner image which have already been transferred onto the intermediary transfer unit 31.

As a result, on the intermediary transfer unit 31, unfixed toner images of the four colors are synthetically formed. Transfer residual toner remaining on the surface of each photosensitive drum 37*a* after the toner image is primary-transferred onto the intermediary transfer unit 31 is removed by the cleaning member 37*c*.

On the other hand, the feeding roller 20 is driven with predetermined control timing. As a result, by a cooperation of the feeding roller 20 and the separation pad 21, the sheets P stacked in the feeding cassette 19 is separated and fed one by one. Then, the sheet P is introduced into a nip (secondary transfer nip) between the intermediary transfer unit 31 and the secondary transfer roller 22. As a result, the four color toner images on the intermediary transfer unit 31 are successively and collectively transferred onto the sheet P in a process in which the sheet P is nip-conveyed in the nip.

The sheet P is separated from the surface of the intermediary transfer unit 31 and is introduced into the fixing member 23 in which the sheet P is to be heated and pressed in a fixing nip. As a result, color mixing and fixing of the respective toner images on the sheet P are effected. Then, the sheet P comes out of the fixing member 23 and is discharged on the discharging tray 25 by a discharging roller pair 24 as an image-formed product.

Secondary transfer residual toner remaining on the surface of the intermediary transfer unit 31 after the separation of the sheet P is charged by a cleaning roller 26*a* as a cleaning member provided in the cleaning unit 26. The cleaning roller 27*a* as the cleaning member removes the developer remaining on the surface of the intermediary transfer unit 31 as the intermediary transfer member and also is supported so as to be movable toward and away from the intermediary transfer unit 31. The developer is electrostatically deposited on the surface of the photosensitive drum 37*a* at the primary transfer portion of the first photosensitive unit 37 and is removed by the cleaning member 37*a*.

Next, a maintenance operation method for removing the sheet P in the case where the sheet P is left in the image forming apparatus 100 and for exchanging the developing cartridge 38 and the intermediary transfer unit 31 will be described.

Figure 3:
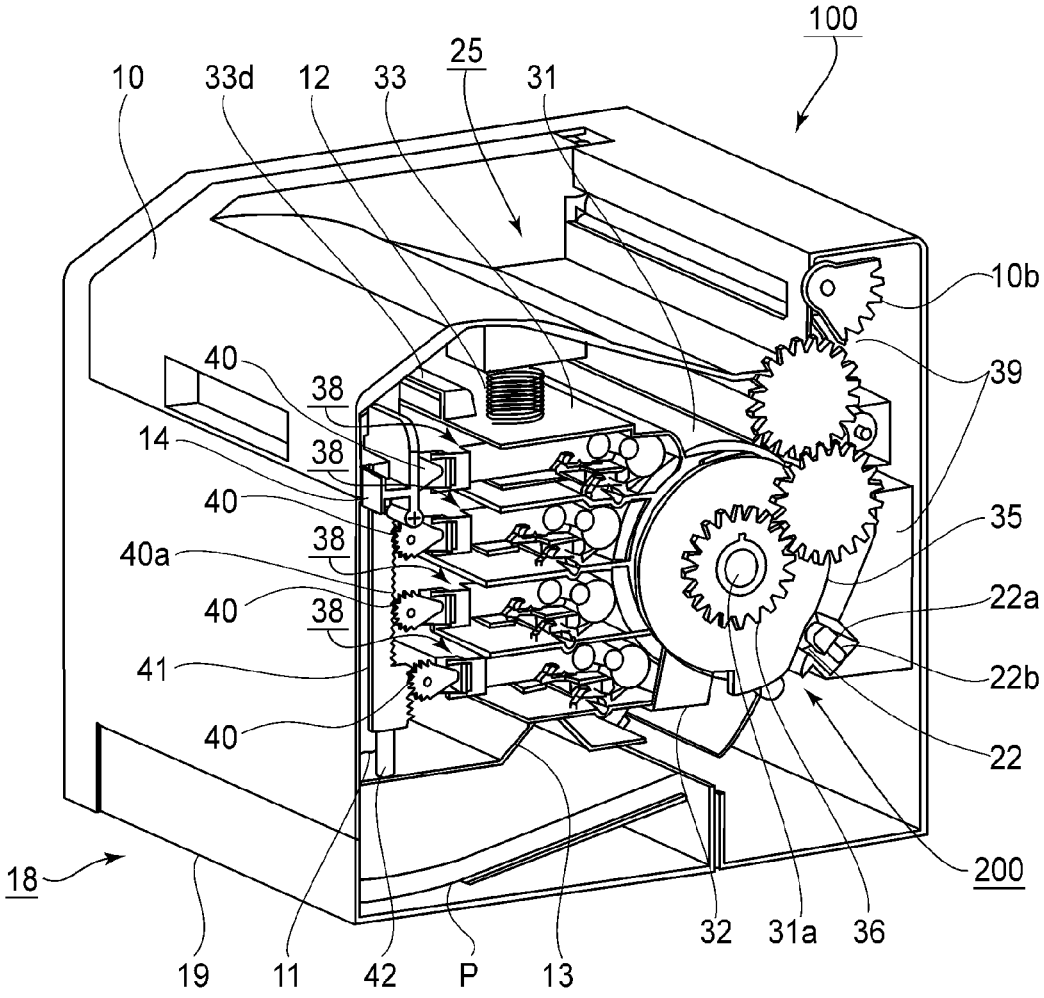
FIGS. 3 and 4 are a perspective view and a sectional view, respectively, of the image forming apparatus according to First Embodiment of the present invention during an image forming operation.
Figure 4:
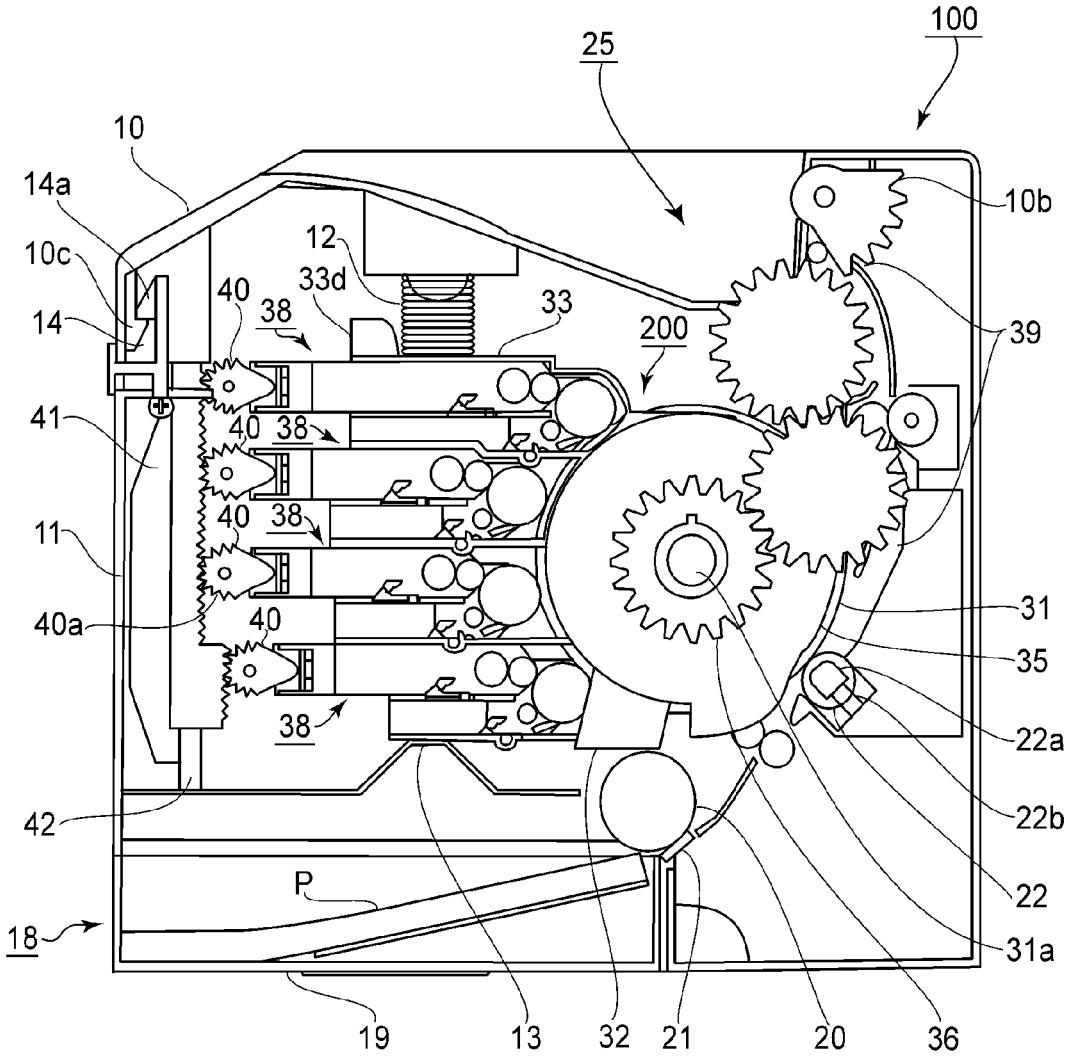
Figure 5:
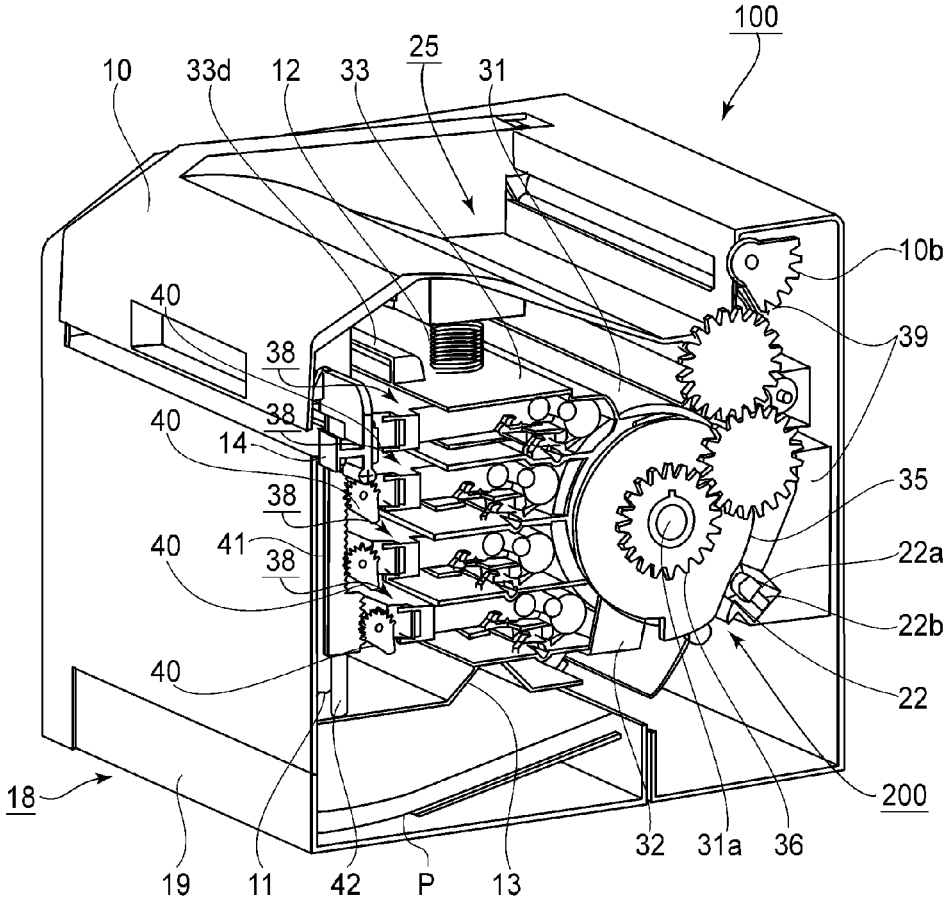
FIGS. 5 and 6 are a perspective view and a sectional view, respectively, of the image forming apparatus according to First Embodiment of the present invention in a partly opened state of a maintenance cover.
Figure 6:
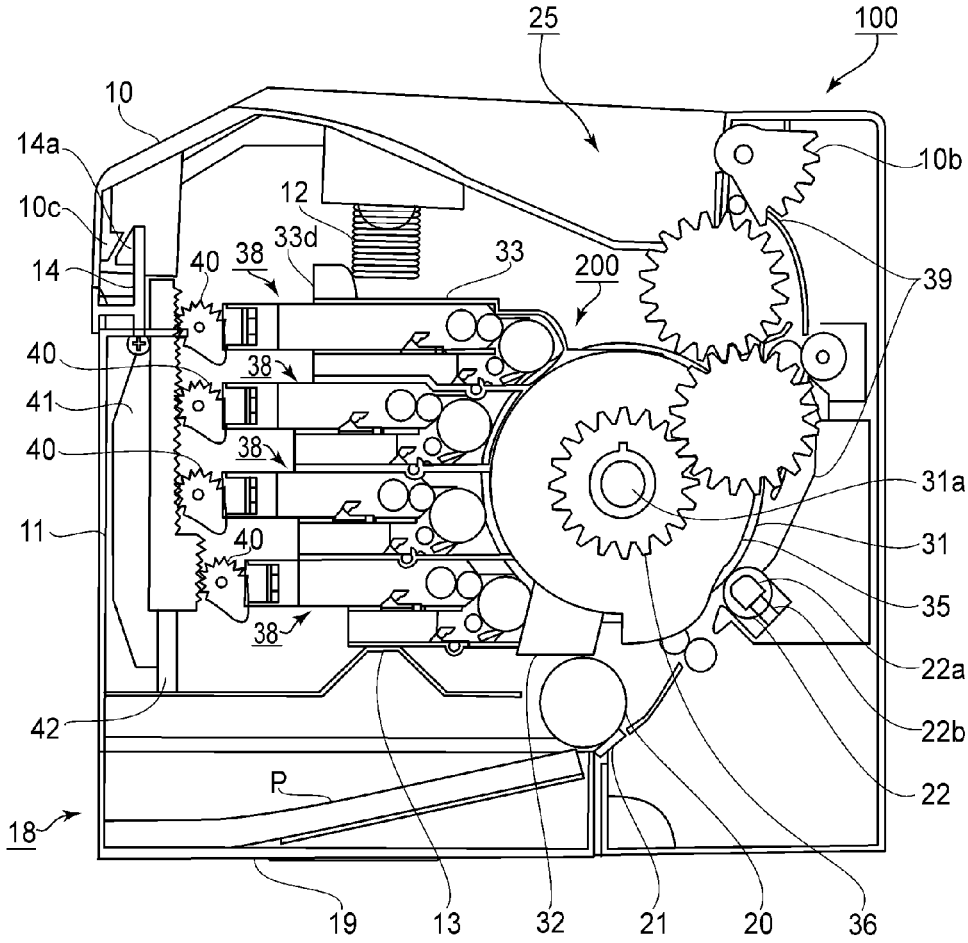
Figure 7:
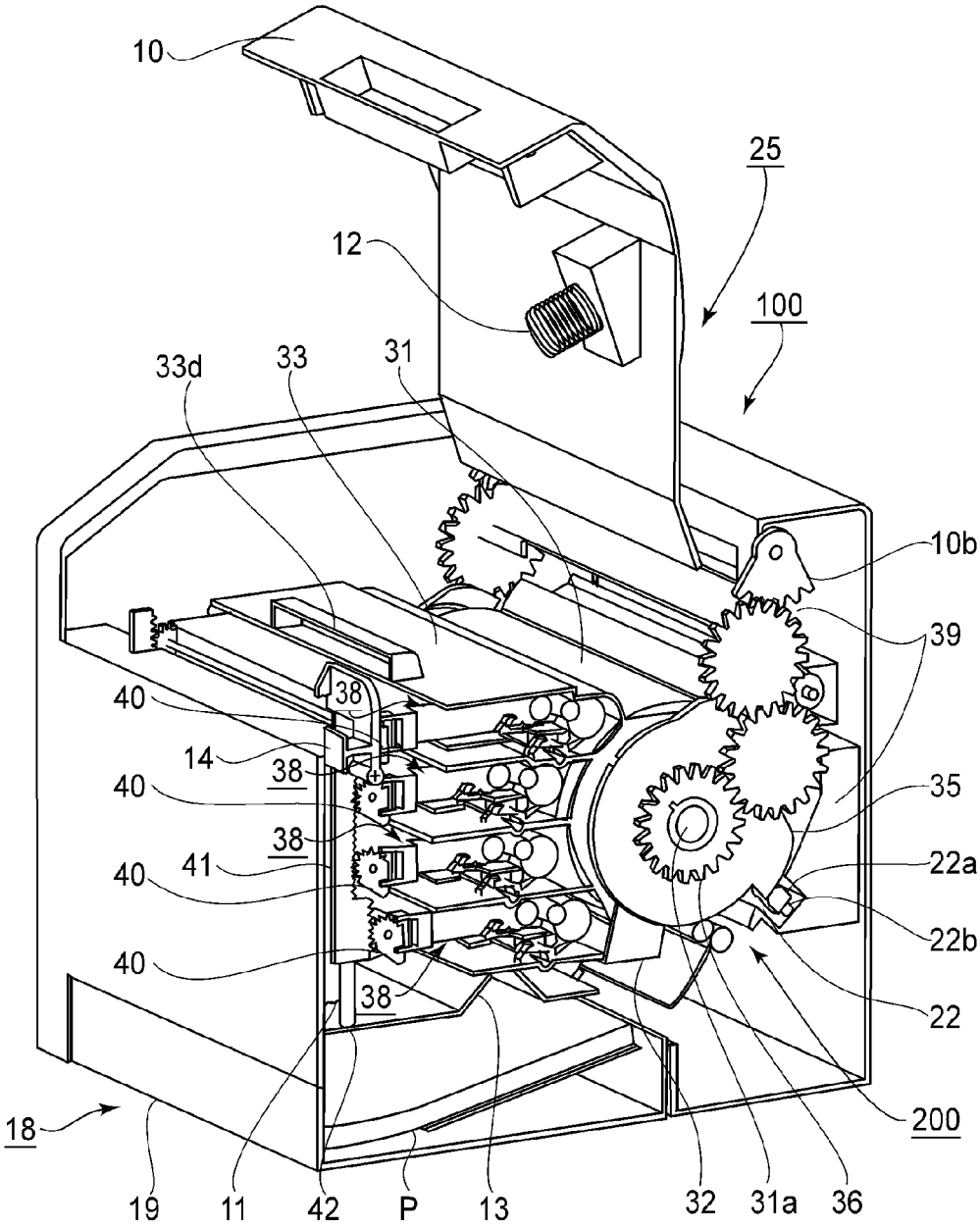
FIGS. 7 and 8 are a perspective view and a sectional view, respectively, of the image forming apparatus according to First Embodiment of the present invention in an opened state of the maintenance cover.
Figure 8:
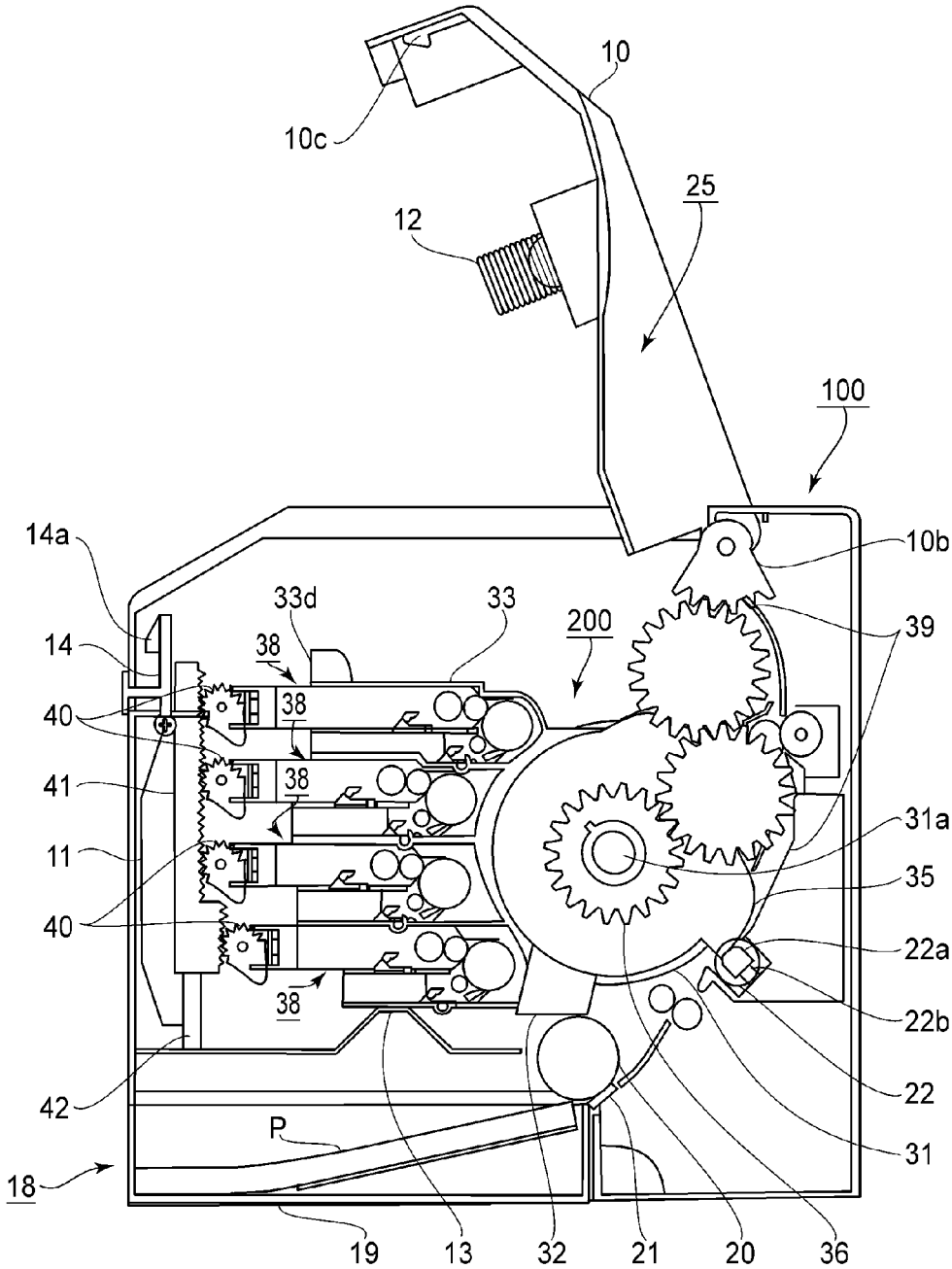
Figure 9:
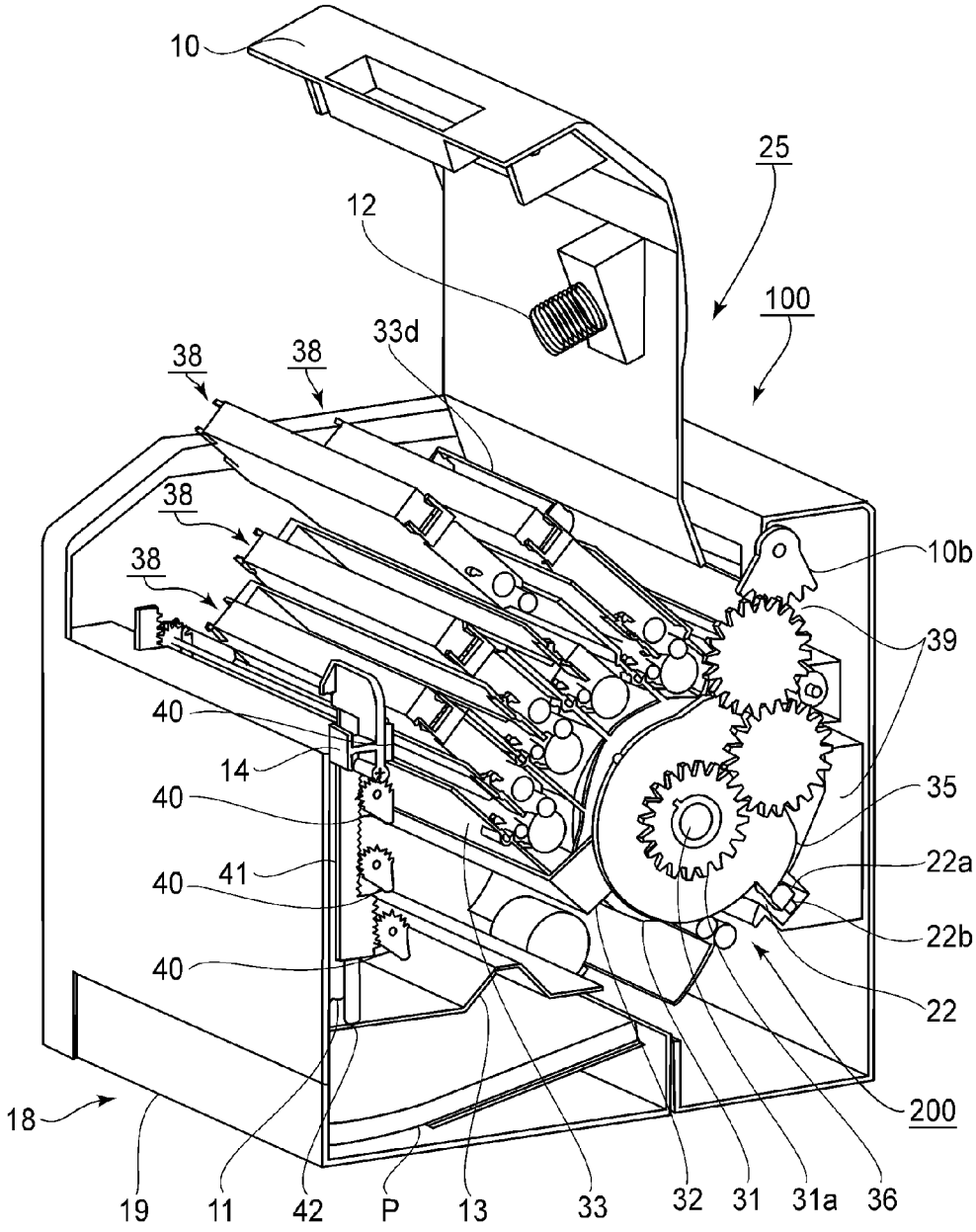
FIGS. 9 and 10 are a perspective view and a sectional view, respectively, of the image forming apparatus according to First Embodiment of the present invention during exchange of a developing cartridge.

FIGS. 3 to 10 are schematic views showing features of the present invention. FIG. 3 is a perspective view of the image forming apparatus 100 in this embodiment during printing, and FIGS. 5, 7 and 9 are perspective views of the image forming apparatus 100 in this embodiment during the maintenance operation. FIG. 5 shows a partly open state of the maintenance cover 10 (an urging-released position of the developing cartridge 38). FIG. 7 shows a completely open state of the maintenance cover 10 (a state in which the removal of the sheet P is performed). FIG. 9 shows a state in which the cartridge tray 33 is rotationally moved to a position in which the developing cartridge 38 can be dismounted and mounted.

Further, FIGS. 4, 6, 8 and 10 are sectional views corresponding to FIGS. 3, 5, 7 and 9, respectively. At an upper portion of the casing, the maintenance cover 10 covering the upper surface of the image forming apparatus 100 is provided and can be rotated about a hinge portion 10*a*. The sheet P wound about the intermediary transfer unit 31 and left in the image forming apparatus 100 can be removed from a space formed by opening the maintenance cover 10. Further, the cartridge tray 33 can be rotated about the center shaft 31*a* of the intermediary transfer unit 31. In a state in which the maintenance cover 10 is opened, by rotating the cartridge tray 33, the developing cartridge 38 is moved to a mountable and dismountable position, so that the developing cartridge 38 and the intermediary transfer unit 31 can be exchanged. That is, in interrelation with the opening operation of the maintenance cover 10, the cartridge tray 33 is rotated to facilitate the mounting and dismounting of the developing cartridge 38.

The maintenance cover 10 is provided with an urging spring 12, between itself and the cartridge tray 33, for urging the maintenance cover 10 in the clockwise direction and for urging the cartridge tray 33 in the counterclockwise direction. A closed state is maintained by engagement between a claw portion 14*a* provided on a maintenance button 14 disposed on a front surface of the apparatus main assembly 100 and a claw portion 10*c* provided on the maintenance cover 10.

Each developing cartridge 38 is accommodated in the image forming unit 200, and the cartridge tray 33 is urged in the counterclockwise direction shown in FIG. 1 by the urging spring 38. Then, the cartridge tray 33 abuts on a main stay 13 provided in the apparatus main assembly 100, so that the image forming unit 200 is positioned at a position in which the image is formed with reliability.

During the image formation in the state in which the maintenance cover 10 is closed, as shown in FIG. 3, each urging member 40 movable between a contact position and a separation position in which closing and opening of the maintenance cover 10 is held at the contact position, so that each developing cartridge 38 is urged at predetermined pressure. Here, each urging member 40 includes a gear portion 40*a*. Four urging members 40 are interrelated with each other by an urging rack 41 to perform a contact and separation operation. The urging rack 41 is provided with urging rack spring 42 for urging the urging rack 41 upward in the apparatus main assembly 100. Further, in the state in which the maintenance cover 10 is closed, the urging rack 41 is pressed downward in the apparatus main assembly 100 against the urging force of the urging spring 42, so that each urging member 40 is retained in a contact state with the developing cartridge 38. The gear portion 40*a* of each urging member 40 may be provided integrally or separately. Further, in place of rack and pinion, it is also possible to employ a combination of gears.

When the user presses the maintenance button 14, latch engagement between the button 14 and the maintenance cover 10 is released, so that the maintenance cover 10 urged in the clockwise direction by the urging spring 12 is rotationally moved by a distance corresponding to an operation length of the urging spring 12. During the process, as shown in FIG. 5, the urging rack 41 is moved upward in the apparatus main assembly 100 depending on the urging force of the urging rack spring 42, so that the urging members 40 which have urged the developing cartridges 8 are interrelated with each other to release the urging force.

The maintenance cover 10 includes a gear 10*b* which is connected to a gear 36 for driving a cam plate 35 of the image forming unit 200 through a gear portion 39. Therefore, in interrelation with a rotating operation of the maintenance cover 10, the cam plate 35 is rotated at a predetermined angle. That is, a drive transmitting means connecting the maintenance cover 10 as a door with the cam plate 35 as a spacing (separating) means is provided. The drive transmitting means is constituted by the gear 10*b* rotated integrally with the maintenance cover 10, the gear portion 39 engaged with the gear 10*b*, and the gear 36 which is engaged with the gear portion 39 and is rotated integrally with the cam plate 35. By transmitting driving force for opening and closing the maintenance cover 10 to the cam plate 35 through the drive transmitting means, the cleaning roller 26*a* as the cleaning member is spaced from the intermediary transfer unit 31 as the intermediary transfer member. The gear 10*b* may also be provided integrally with or separately from the maintenance cover 10. Further, this constitution may also be realized by a combination of rotational motion and linear motion such as the rack and pinion.

In this embodiment, as shown in FIG. 4, during the image formation in the state in which the maintenance cover 10 is completely closed, the driving force is not transmitted between the gear 10*b* of the maintenance cover 10 and the gear portion 39. As a result, the positioning of the image forming unit 200 relative to the apparatus main assembly 100 can be realized with reliability irrespective of the position of the maintenance cover 10.

Next, as show in FIGS. 7 and 8, when the user opens the maintenance cover 10 upward further relative to the apparatus main assembly 100, the driving force is transmitted between the gear 36 of the cam plate 35 and the gear 10*b* of the maintenance cover 10, so that the cam plate 35 is rotated at a predetermined angle. By this rotation operation of the cam plate 35, the photosensitive unit 37 of the cartridge tray 33, the secondary transfer roller 22, and the cleaning roller 26*a* of the cleaning unit 26 are spaced from the intermediary transfer unit 31. That is, the cam plate 35 brings the cleaning roller 26*a* as the cleaning member into contact to the intermediary transfer unit 31 as the intermediary transfer member in the state in which the maintenance cover 10 as the door is closed and the image formation is effected. Further, the cam plate 35 is also constituted as the spacing means for spacing the cleaning roller 26*a* from the intermediary transfer unit 31 in interrelation with the opening operation of the maintenance cover 10.

Figure 11A:
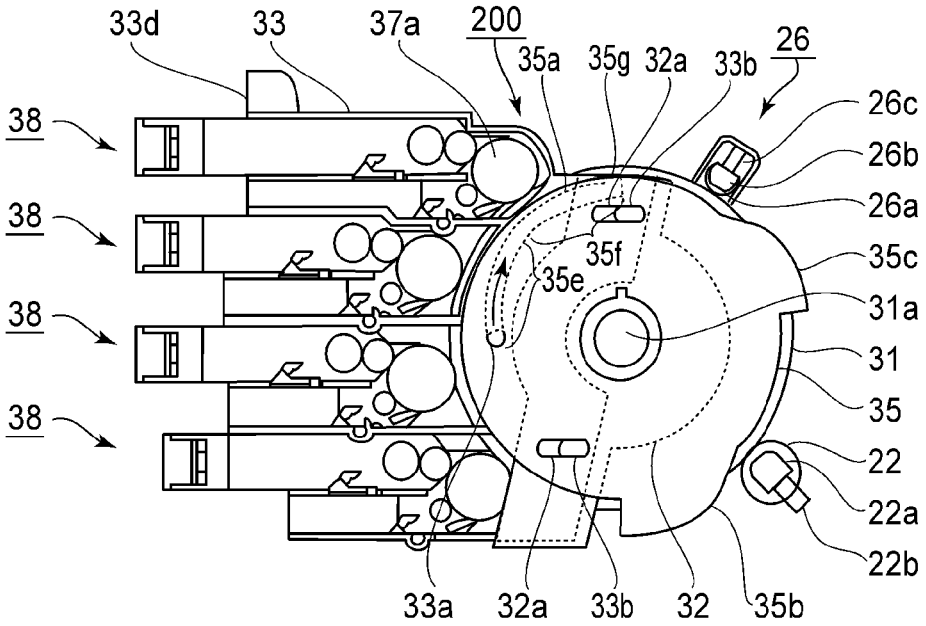
FIGS. 11A to 11D are sectional views for illustrating a spacing (separating) operation among an image forming unit, a photosensitive member, a secondary transfer roller and a cleaning roller in First Embodiment of the present invention.

FIGS. 11A to 11D are schematic views for illustrating a spacing (separating) operation of the cartridge tray 33, the secondary transfer roller 22 and the cleaning unit 26 performed in interrelation with the cam plate 35. FIG. 11A shows a state during the image formation in which the maintenance cover 10 is closed. The secondary transfer roller 22 is supported by bearings 22*a* at its end portions so as to be movable in a radial direction of the intermediary transfer unit 31. The bearing 22*a* is urged by the urging spring 22*b*, so that the secondary transfer roller 22 is urged against the intermediary transfer unit 31 with predetermined pressure. The cleaning roller 26*a* is supported by bearing 26*b* at its end portions so as to be movable in the radial direction of the intermediary transfer unit 31. The bearing 26*b* is urged by an urging spring 26*c*, so that the cleaning roller 26*a* is urged against the intermediary transfer unit 31 with predetermined pressure.

Figure 11B:
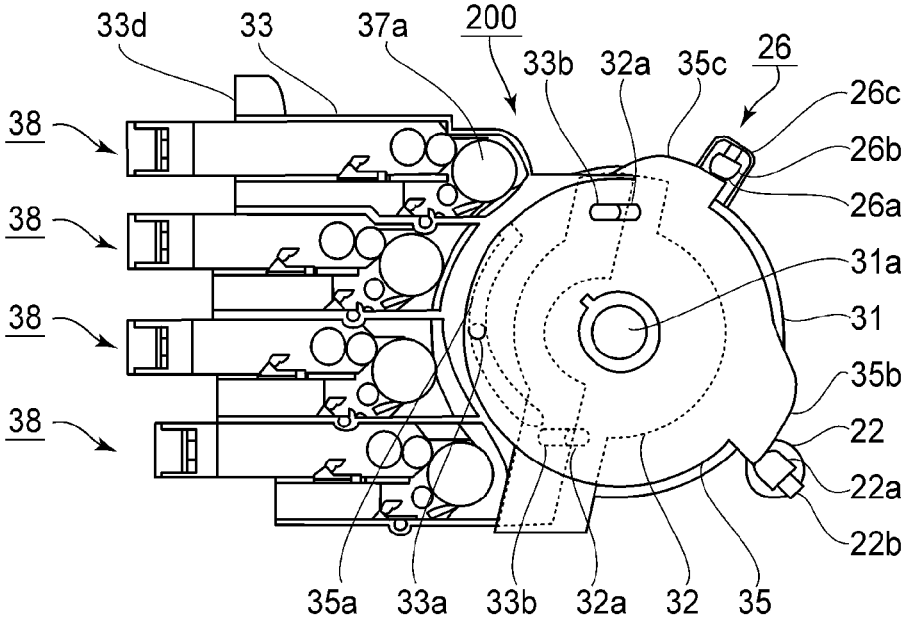

FIG. 11B shows a state (FIGS. 7 and 8) in which the user opens the maintenance cover 10 upward. As described above, in interrelation with the rotating operation of the maintenance cover 10, the cam plate 35 is rotated about the center shaft 31*a* of the intermediary transfer unit 31 from the state of FIG. 11A by a predetermined angle. The groove portion 35*a* provided on the cam plate 35 is formed so that a distance between itself and the center of the intermediary transfer unit 31 is gradually increased with movement in an arrow direction in FIG. 11A. Therefore, where the cam plate 35 is rotated, the cartridge tray 33 is moved forward in the apparatus main assembly 100 by movement of the round boss 33*a* along the groove portion 35*a*. By this movement of the cartridge tray 33, the intermediary transfer unit 31 and the photosensitive units 27 are placed in a spaced state.

The cam plate 35 includes a cam portions 35*b* and 35*c*. When the cam plate 35 is rotated to the position of FIG. 11B, the cam portions 35*b* and 35*c* contact the bearing 22*a* of the secondary transfer roller 22 and the bearing 26*b* of the cleaning roller 26*a*, respectively. As a result, the secondary transfer roller 22 and the cleaning roller 26*a* are spaced from the intermediary transfer unit 31 against the urging forces of the urging springs 22*b* and 26*c*, respectively.

Thus, when the upper opens the maintenance cover 10 upward, the photosensitive units 37, the secondary transfer roller 22 and the cleaning roller 26*a* are spaced from the intermediary transfer unit 31 without requiring a particular operation. As a result, even when jam such that the sheet P is jammed between the intermediary transfer unit 31 and the cleaning roller 26*a* or the photosensitive unit 37 due to winding thereof about the intermediary transfer unit 31, or the like occurs, the user can easily remove the jammed sheet P only by opening the maintenance cover 10.

Figure 10:
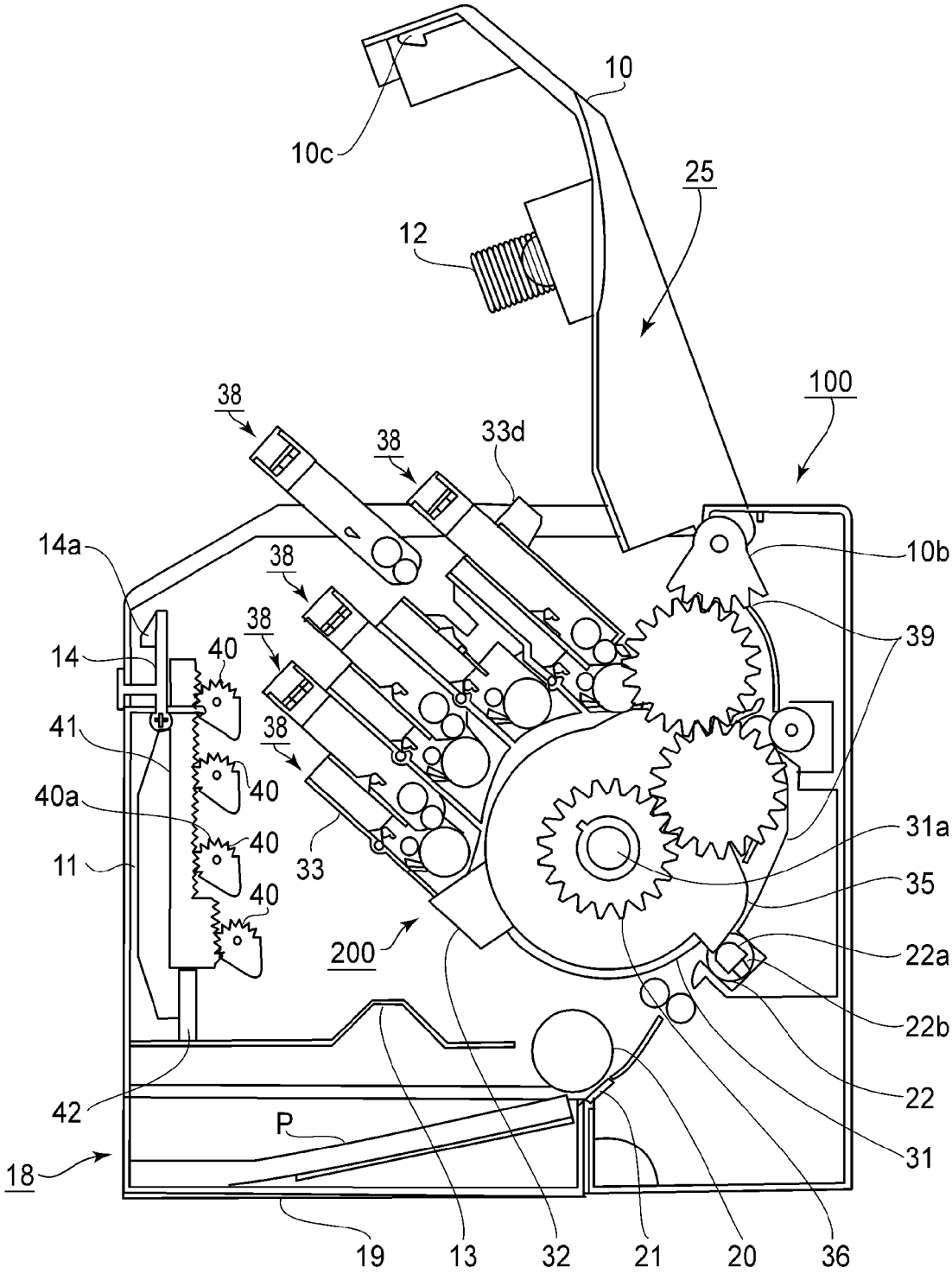
Figure 11C:
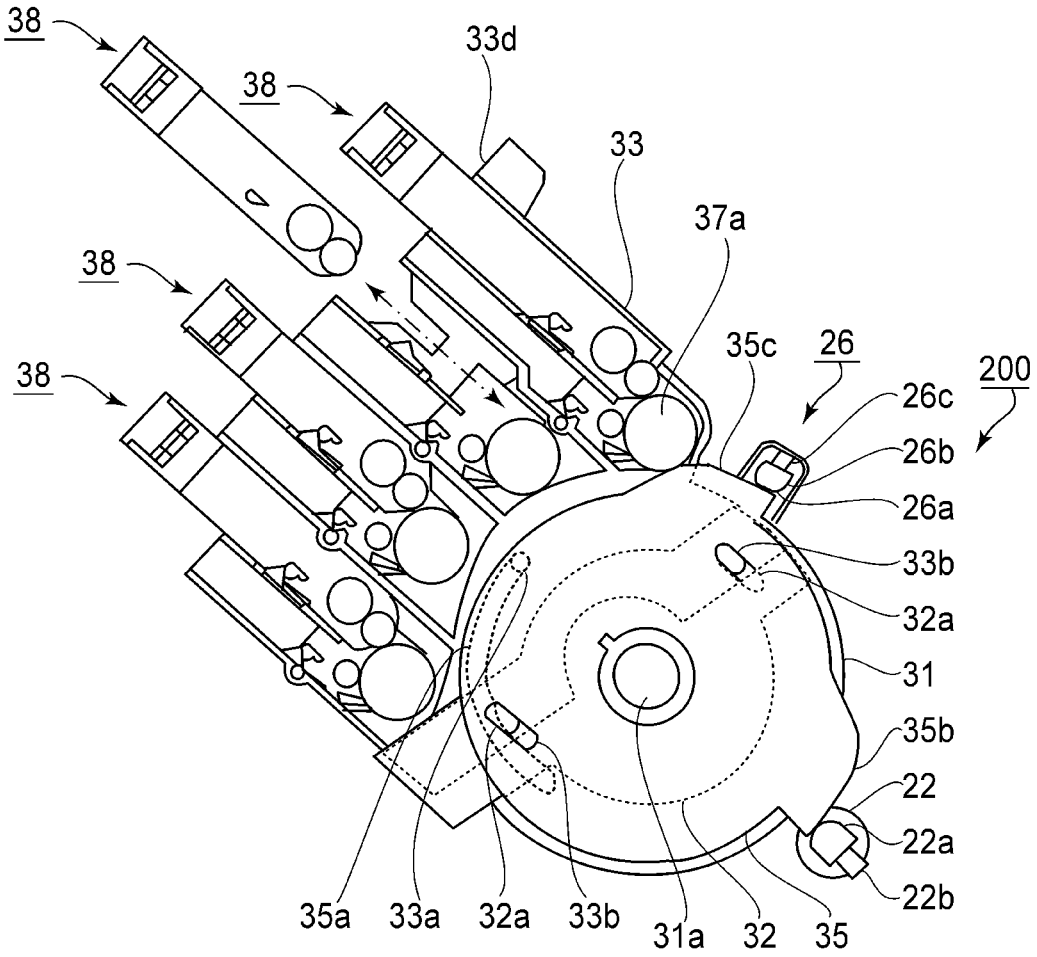

In the case where the developing cartridge 38 and the intermediary transfer unit 31 are exchanged, as shown in FIGS. 9 and 10, the user grips a grip portion 33*d* of the cartridge tray 33 in the state in which the maintenance cover 10 is opened. Then, the user rotates the cartridge tray 33, together with the sub-frame 32, upward about the center of the intermediary transfer unit 31 as an rotational axis. As a result, the developing cartridge 38 is rotated and moved to its mounting and dismounting position, so that the developing cartridge 38 can be mounted in and dismounted from the apparatus main assembly 100 through the upper opening. At this time, an unshown drive transmitting means is released, so that the drive transmission from the apparatus main assembly 100 to the intermediary transfer unit 31 is released. Further, the groove portion 35*a* of the cam plate 35 is provided with an open portion 35*g* so that the round boss 33*a* of the cartridge tray 33 can be dismounted from the cam plate 35. For this reason, the cartridge tray 33 and the sub-frame 32 can be dismounted from the image forming apparatus 100 together with the intermediary transfer unit 31. The groove portion 35*a* of the cam plate 35 is formed in an area 35*f* so that a distance between itself and the intermediary transfer unit 31 is constant. Therefore, as shown in FIG. 11C, even when the cartridge tray 33 is rotated upward, the spaced state between the intermediary transfer unit 31 and the photosensitive units 37 is maintained. For this reason, it is possible to prevent surface damage of the photosensitive drums 37*a* and the intermediary transfer unit 31 due to rubbing between the photosensitive units 37 and the intermediary transfer unit 31 thereto to prevent deterioration of the image.

Figure 11D:
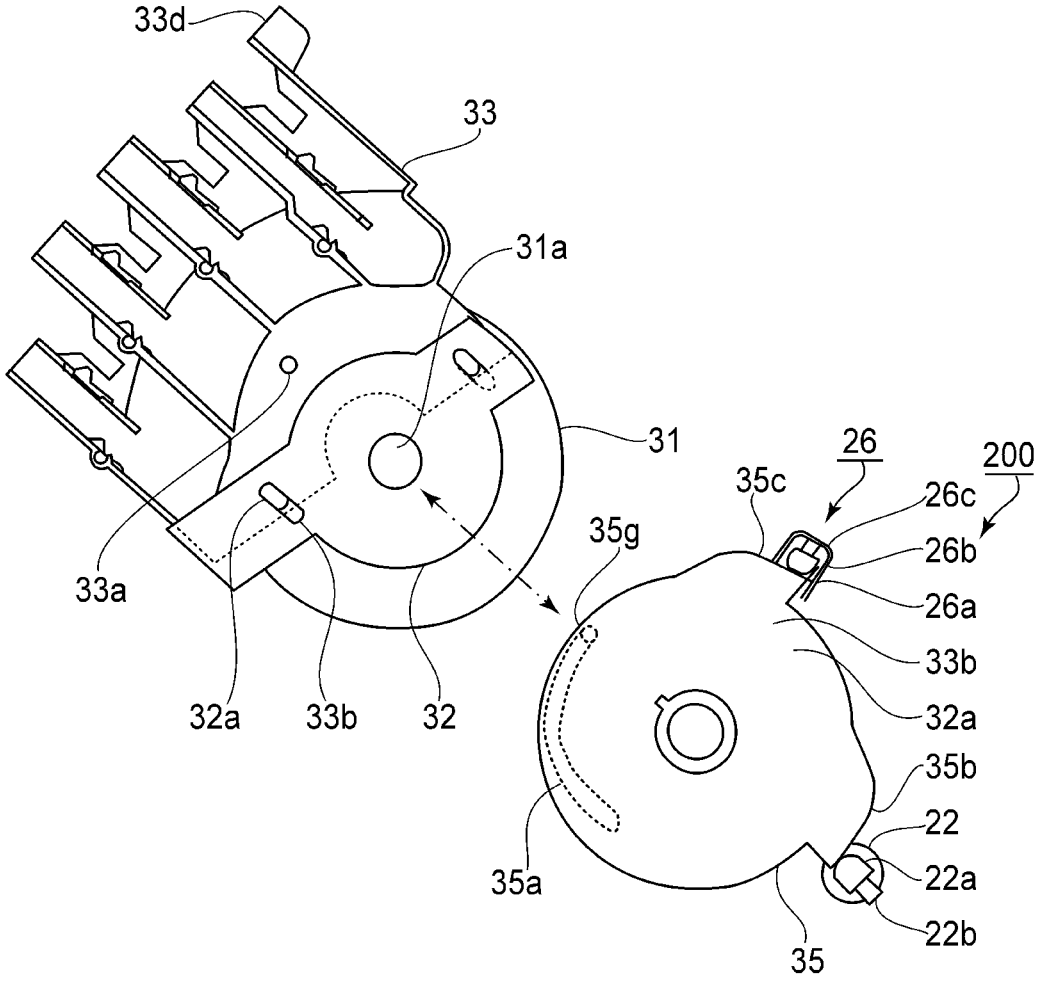

In the state of FIG. 11C, the exchange of the developing cartridge 38 is performed and the exchange of the intermediary transfer unit 31 is performed. In this case, as shown in FIG. 11D, the round boss 33*a* of the cartridge tray 33 is positionally aligned with the open portion 35*g* provided in the groove portion 35*a* of the cam plate 35. As a result, the intermediary transfer unit 31 is dismounted from and mounted in the apparatus main assembly 100 together with the sub-frame 32 and the cartridge tray 33. The open portion 35*g* provided in the groove portion 35*a* of the cam plate 35 permits the rotation of the cam plate 35, so that the cleaning roller 26*a*, the secondary transfer roller 22 and the photosensitive units 37 are spaced from the intermediary transfer unit 31. Otherwise the open portion 35*g* is formed at a position in which the round boss 33*a* of the cartridge tray 33 cannot pass through the open portion 35*g*. That is, the cam plate 35 also functions as a locking means for preventing the cartridge tray 33 and the intermediary transfer unit 31 from being mounted and dismounted unless the cleaning roller 26*a*, the secondary transfer roller 22 and the photosensitive units 37 are spaced from the intermediary transfer unit 31. That is, the intermediary transfer unit 31 as the intermediary transfer member is detachably mountable to the apparatus main assembly 100. The cam plate 35 as the spacing means includes the groove portion 35*a* as the locking means for locking the intermediary transfer unit 31 at the image formation position. The locking means also includes the round boss 33*a* movably along and engaged with the groove portion 35*a* and includes the open portion 35*g* per permitting mounting and dismounting of the boss 33*a* with respect to the groove portion 35*a*. The cam plate 35 is rotated by opening the maintenance cover 10 as the door, so that the round boss 33*a* engaged with the groove 35*a* is disconnected from the open portion 35*g* to release the locking by the locking means. In this embodiment, the cam plate 35 as the spacing means for spacing the cleaning roller 26*a* as the cleaning member from the intermediary transfer unit 31 as the intermediary transfer member also functions as the locking means for locking the intermediary transfer unit 31 at the image formation position. The cam plate 35 as the spacing means includes the cam portions 35*b* and 35*c*. The cam portions 35*b* and 35*c* of the cam plate 35 are operated in interrelation with the opening and closing operation of the maintenance cover 10 as the door. As a result, the cleaning roller 26*a* as the cleaning member is spaced from the intermediary transfer unit 31 as the intermediary transfer member. Further, the cam portions 35*b* and 35*c* of the cam plate 35 are rotatably supported about the rotation shaft (the center shaft) 31*a* of the intermediary transfer unit 31 as the intermediary transfer member. Further, the cleaning roller 26*a* as the cleaning member is spaced from the intermediary transfer unit 31 as the intermediary transfer member by the cam plate 35 as the spacing means. In interrelation with this operation, either one or both of the developing cartridge 38 as the developer holding unit and the secondary transfer roller 22 as the transfer member are spaced from the intermediary transfer unit 31.

When the jam clearance of the sheet P left in the apparatus main assembly 100 or the exchange of the developing cartridge 38 is completed, the user closes the maintenance cover 10 to place the apparatus main assembly 100 in the state of FIGS. 3 and 4. At this time, by the action of the round boss 33*a* of the cartridge tray 33 and the groove portion 35*a* of the cam plate 35, as shown in FIG. 11A, the photosensitive unit 37 is moved to the positions in which the photosensitive units 37 contact the intermediary transfer unit 31. Further, the cam portions 35*b* and 35*c* of the cam plate 35 and the bearings 22*a* and 26*b* of the secondary transfer roller 22 and the cleaning roller 26*a* are spaced from each other. Then, the secondary transfer roller 22 and the cleaning roller 26*a* are in a state in which they are pressed against the intermediary transfer unit 31 by the urging forces of the urging springs 22*b* and 26*c*. Further, the maintenance cover 10 contacts the urging rack 41 to press the urging rack 41 toward a lower side of the apparatus main assembly 100, so that the urging member 40 contacts the developing cartridge 38. Thus, the developing cartridge 38 is urged against the photosensitive unit 37 with predetermined pressure and is positioned on the photosensitive unit 37.

As described above, in the constitution in this embodiment, the user can space a member contacting the intermediary transfer unit 31 from the intermediary transfer unit 31 by performing the opening operation of the maintenance cover 10. For this reason, the user can easily perform the jam clearance of the sheet P wound about the intermediary transfer unit 31 in the apparatus main assembly 100 without dismounting the developing cartridge 38 and the intermediary transfer unit 31. Further, the jam clearance of the sheet P which is jammed between the intermediary transfer unit 31 and the members of the secondary transfer roller 22, the cleaning unit 26 and the photosensitive units 37 and which is left in the apparatus main assembly 100 can be performed easily, and the image forming apparatus 100 can be restored to a printable state. Further, also when the intermediary transfer unit 31 is dismounted and mounted for its exchange, the rubbing between the intermediary transfer unit 31 and the cleaning roller 26*a* can be prevented, so that the surface of the intermediary transfer unit 31 can be prevented from being damaged and the image deterioration can be prevented.

Incidentally, in this embodiment, the maintenance cover 10 is provided at the upper surface of the apparatus main assembly 100. As other constitutions, it is possible to employ a constitution in which the maintenance cover 10 is provided at a front portion of the apparatus main assembly 100 and is opened together with the laser scanner unit 11 and a constitution in which the maintenance cover 10 is provided at a rear portion of the apparatus main assembly 100.

Second Embodiment

A constitution of an image forming apparatus main assembly 100 in this embodiment is roughly similar to that in First Embodiment. Only a difference between this embodiment and First Embodiment is that the apparatus main assembly 100 in this embodiment further includes a driving source for driving the cam plate 35 as the spacing means for the image forming unit 200 and includes a detecting means for detecting that the maintenance cover 10 is opened. Therefore, the common constitution of the apparatus main assembly 100 will be omitted from description and only a driving constitution of the image forming unit 200 and a maintenance operation method will be described.

Figure 12A:
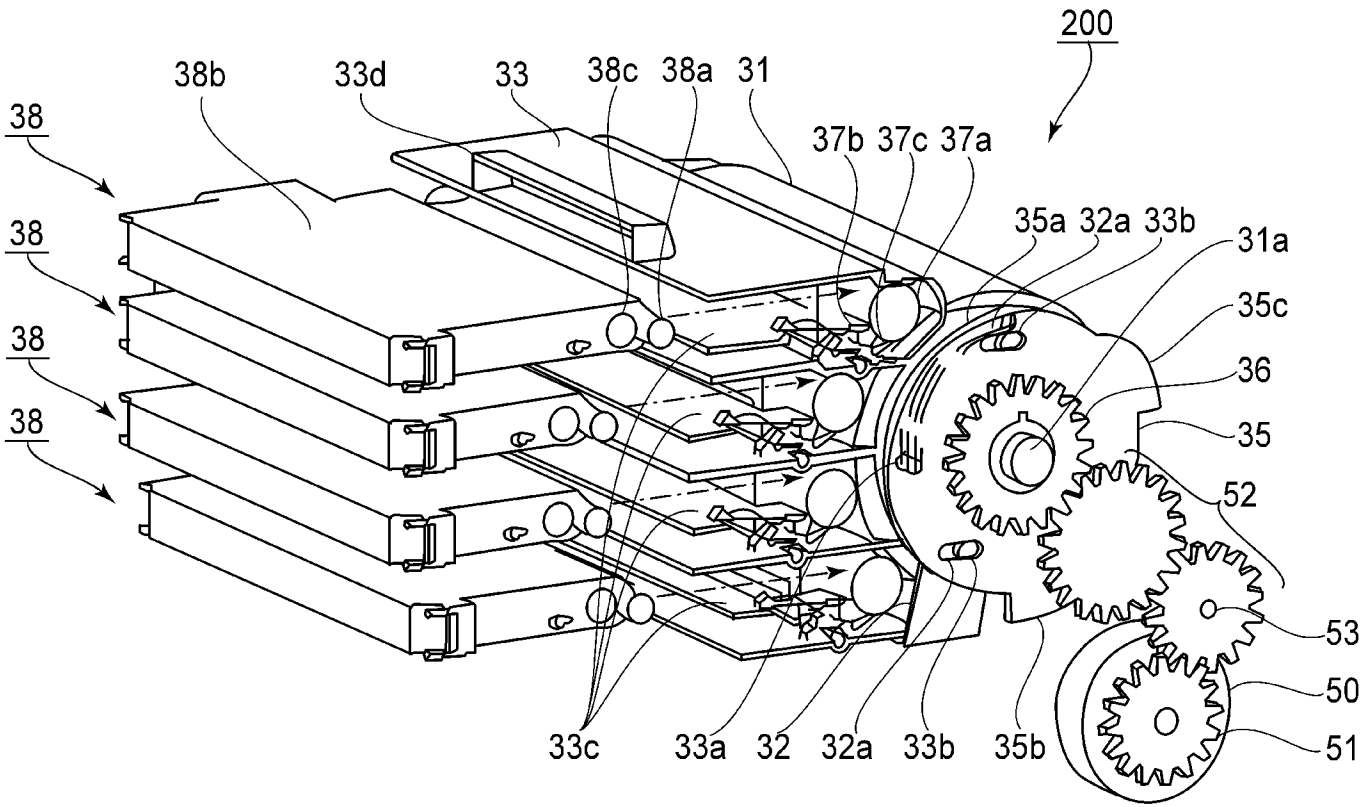
FIGS. 12A and 12B are perspective views of an outer appearance of a developing cartridge, an image forming unit and a cam plate to be mounted in an image forming apparatus according to Second Embodiment of the present invention.
Figure 12B:
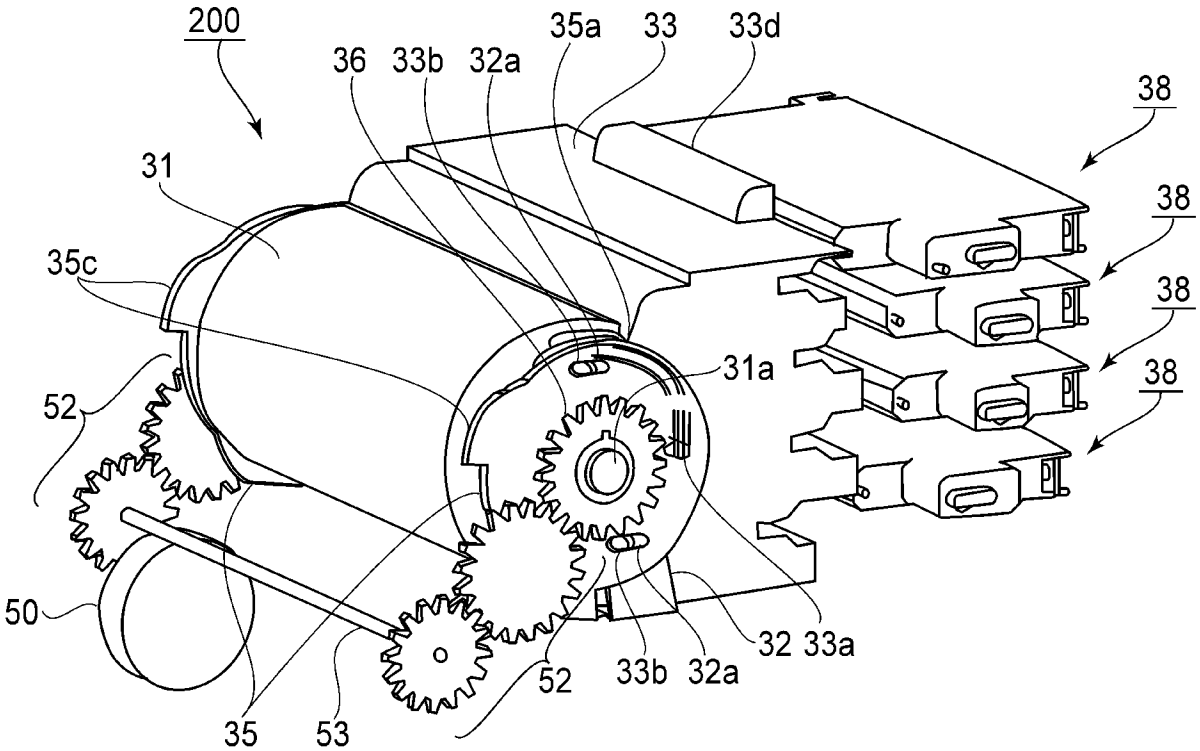

FIGS. 12A and 12B perspective views of the driving constitution for the image forming unit 200, the developing cartridge 38 and the cam plate 35. Different from First Embodiment, in this embodiment, the image forming unit 200 includes a driving source 50 for rotating the cam plate 35. The driving force generated by the driving source 50 is transmitted to the gear 36 connected to the cam plate 35 through a gear 51 provided on the driving source 50 and a gear portion 52. The gear portion 52 is provided with a drive transmitting shaft (axis) 53 through which the driving force of the driving source 50 is transmitted to the two cam plates 35 provided at the end portions of the intermediary transfer unit 31.

The maintenance operation method for performing the removal of the sheet P in the case where the sheet P is left in the image forming apparatus 100 and the exchange of the developing cartridge 38 in this embodiment will be described.

Figure 13:
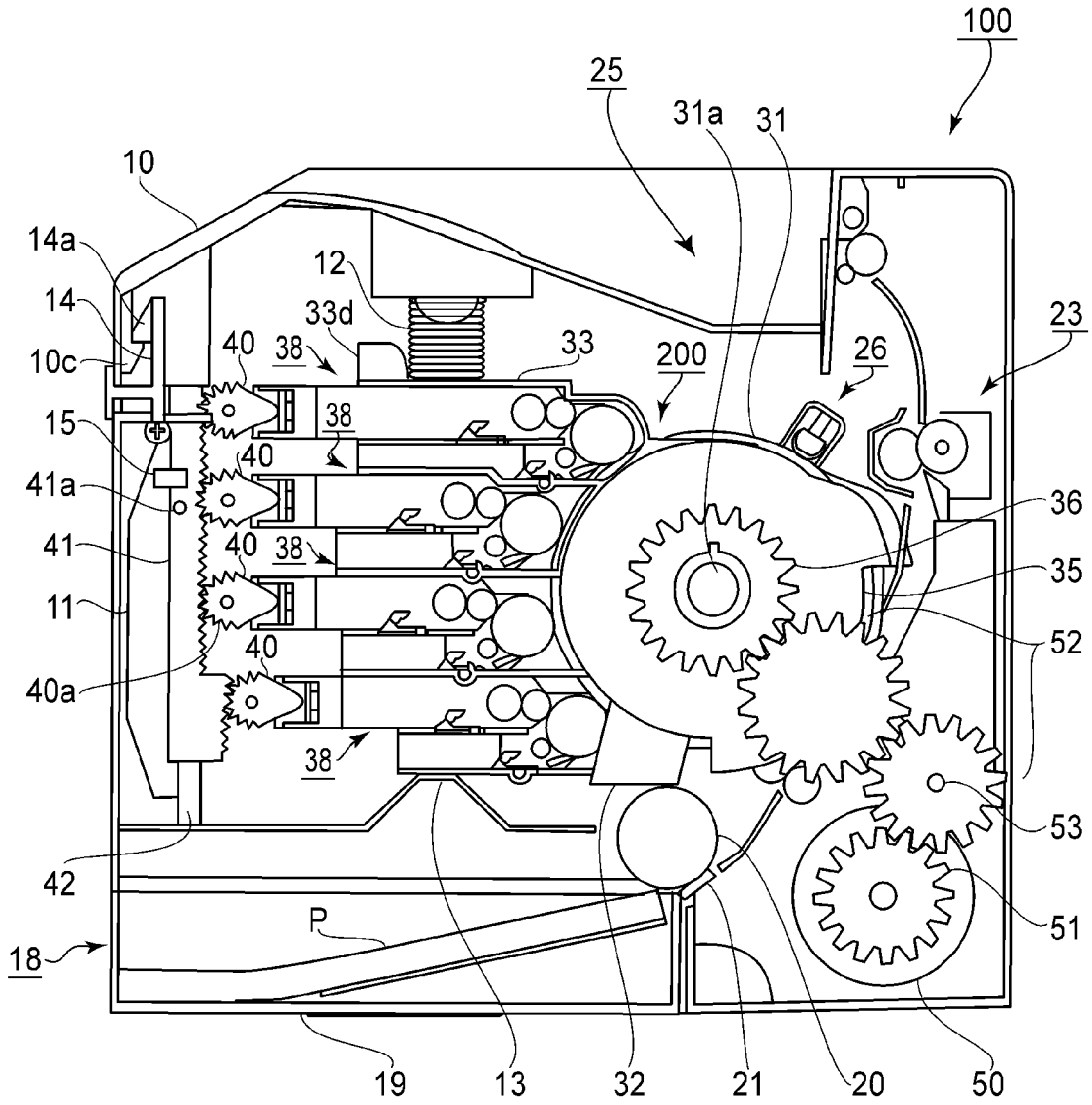
FIG. 13 is a sectional vie of the image forming apparatus according to Second Embodiment of the present invention during an image forming operation.
Figure 14:
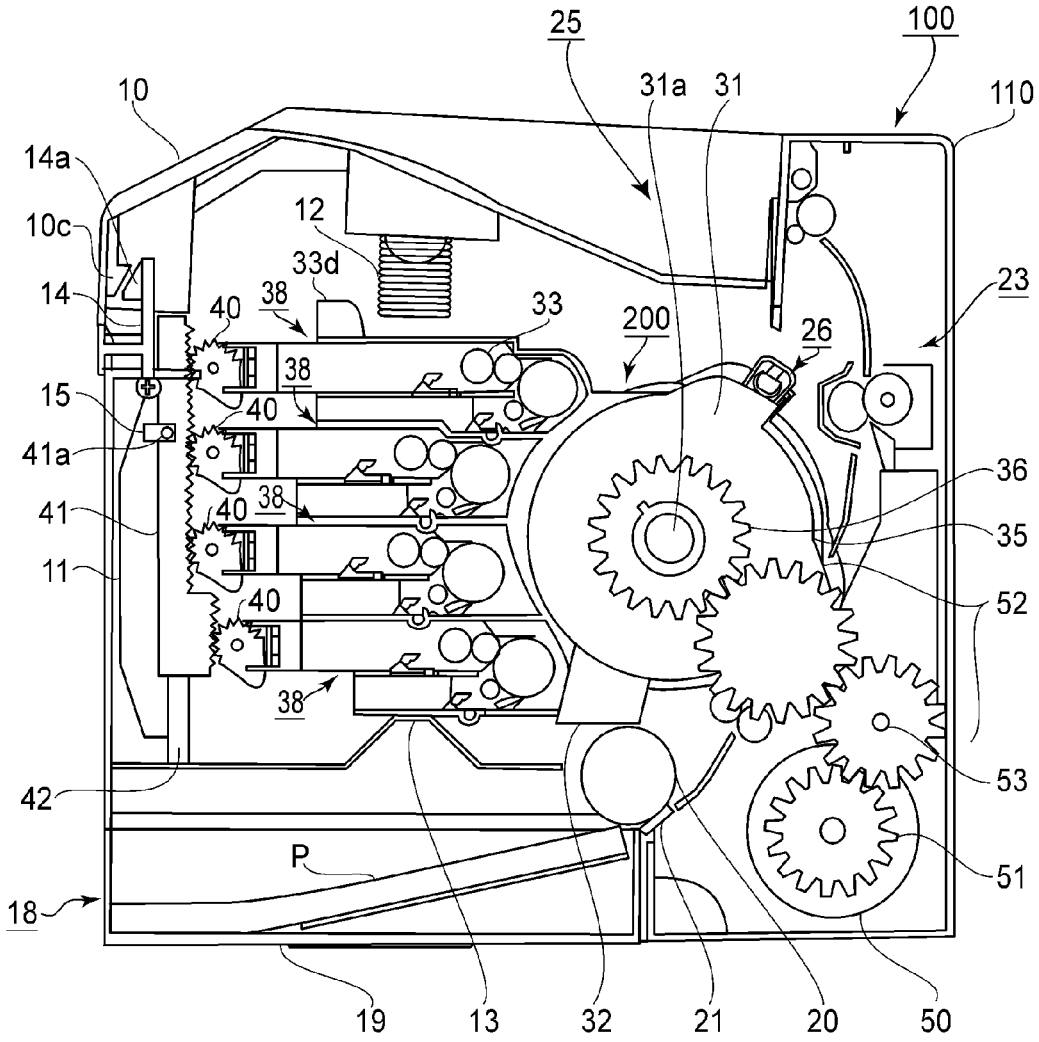
FIG. 14 is a sectional view of the image forming apparatus according to Second Embodiment of the present invention in a partly opened state of a maintenance cover.

FIG. 13 is a sectional view of the image forming apparatus 100 in this embodiment during the printing, and FIG. 14 is a sectional view showing a state in which the maintenance cover 10 is partly opened.

In this embodiment, a sensor 15 as a detecting means for detecting that the maintenance cover 10 is opened is disposed at a position in which the urging rack 41 provided on the front side of the apparatus main assembly is movable. The sensor 15 is a light-transmission sensor for detecting the presence or absence of an object between a light-emitting element and a light-receiving element. The urging rack 41 is provided with a hole through which light passes when the maintenance cover 10 is opened and the urging rack 41 is moved upward. Therefore, when the maintenance cover 10 is placed in a partly open state, the opening of the maintenance cover 10 is detected by the sensor 15 by the upward movement of the urging rack 41.

When the sensor 15 detects that the maintenance cover 10 is opened, a detected signal is sent to an unshown controller. The controller receiving the detected signal sends an instruction signal, to the driving source 50, for rotating the driving source 50 such as a motor or the like by a predetermined angle. The driving source receiving the instruction signal rotates the gear 51, so that the driving force is transmitted to the gear 36 through the gear portion 52 to rotate the cam plate 35 at a predetermined angle.

When the cam plate 35 is rotated, the photosensitive units 37, the secondary transfer roller 22 and the cleaning roller 26*a* are spaced from the intermediary transfer unit 31. This operation is identical to that in First Embodiment.

After the above operations are performed, the user completely opens the maintenance cover 10 and removes the sheet P remaining in the apparatus main assembly 100. Alternatively, the user further rotates the cartridge tray 33 to move the developing cartridge 38 to the mounting and demounting position and then exchanges the developing cartridge 38. This operation method is also identical to that in First Embodiment.

As described above, in this embodiment, the driving source 50 for driving the cam plate 35 and the sensor 15 as the detecting means for detecting that the maintenance cover 10 is opened are added to the constitution of First Embodiment. As a result, it becomes possible to automatically perform the spacing operation for spacing the photosensitive units 37, the secondary transfer roller 22 and the cleaning roller 26*a* from the intermediary transfer unit 31 without being interrelated with the opening and closing operation of the maintenance cover 10. As a result, an operating force for opening and closing the maintenance cover 10 is reduced, so that usability can be further improved compared with the constitution of First Embodiment.

Incidentally, in this embodiment, the light-transmission sensor 15 is used for detecting that the maintenance cover 10 is opened but it is also possible to use other detecting means such as a contact type sensor and the like. Further, the driving source for driving the intermediary transfer unit 31 during the image formation may also function as the driving source for driving the cam plate 35.

Third Embodiment

In First and Second Embodiments, the constitution for spacing the cleaning roller 26*a* as the cleaning member from the intermediary transfer unit 31 as the intermediary transfer member by the cam plate 35 as the spacing means in interrelation with the opening operation of the maintenance cover 10 as the door is described. In this embodiment, a constitution in which a cleaning roller 62 as the cleaning member is spaced from the photosensitive drum 37*a* as the image bearing member in interrelation with the opening operation of the maintenance cover 10 as the door is employed.

Figure 15:
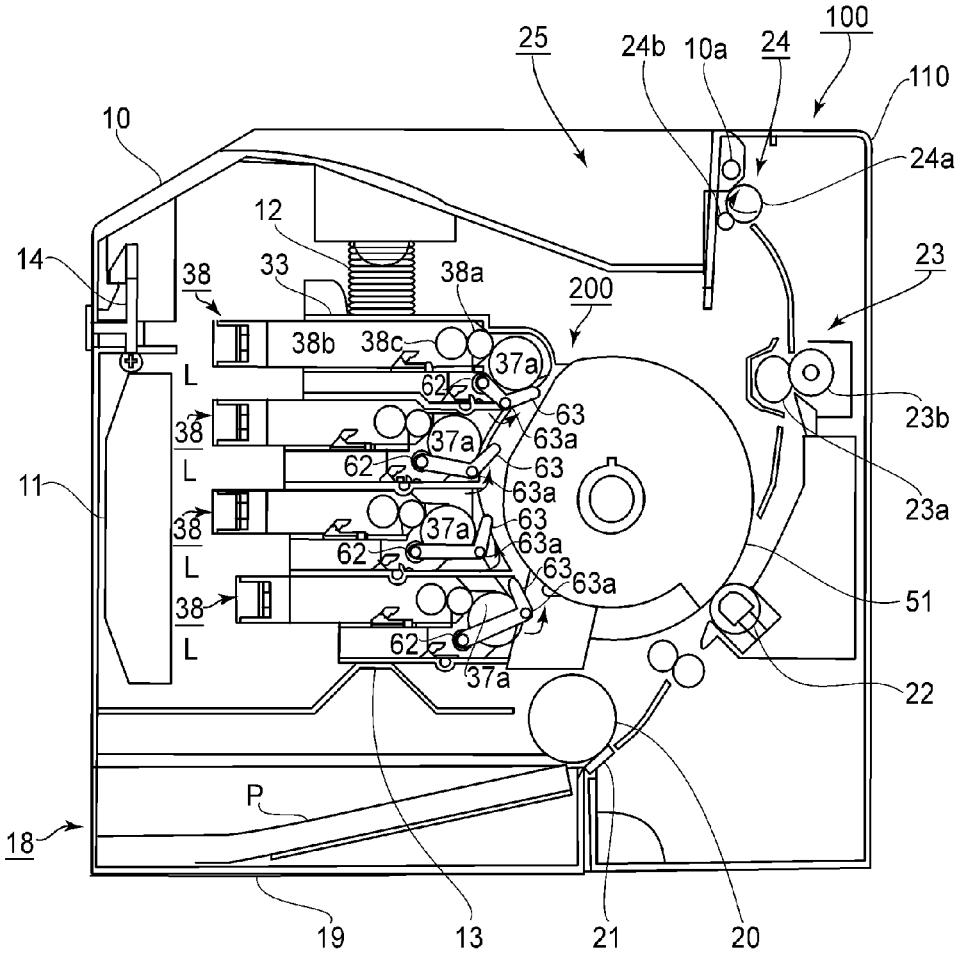
FIG. 15 is a sectional view showing a structure of an image forming apparatus according to Third Embodiment of the present invention.

As shown in FIG. 15, the image forming apparatus 100 in this embodiment includes the photosensitive drums 37*a* as the image bearing member on which the toner image of the developer is carried and includes the maintenance cover 10 as the door for covering an opening through which the sheet P remaining in the image forming apparatus main assembly 100 is to be removed. Further, the image forming apparatus 100 includes the cleaning rollers 62 as the cleaning member, for removing the developer remaining on the surface of the photosensitive drum 37*a* (the image bearing member), supported so as to be movable toward and away from the photosensitive drum 37*a*. The cleaning roller 62 is rotatably supported by a link 63. The link 63 is supported by the cartridge tray 33 so as to be rotatable about a rotation shaft 63*a*. Further, in the state in which the maintenance cover 10 is closed and the image formation is effected, the cleaning roller 62 is brought into contact with the photosensitive drum 37*a* by an unshown urging means. Further, the image forming apparatus 100 includes the cam plate 61 as the spacing means for spacing the cleaning roller 62 from the photosensitive drum 37*a* in interrelation with the opening operation of the maintenance cover 10. The cam plate 61 is rotated in the counterclockwise direction shown by an arrow in FIG. 15 in interrelation with the opening operation of the maintenance cover 10 to contact the link 63. The link 63 is rotationally moved, against the urging force, in the arrow direction shown in FIG. 15 by the cam plate 61, so that the cleaning roller 62 is spaced from the photosensitive drum 37*a*. Other operations in this embodiment are substantially identical to those in First and Second Embodiments, and similar effects can be achieved also in this embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 248063/2009 filed Oct. 28, 2009, which is hereby incorporated by reference.

What is claimed is:

1. An image forming apparatus comprising:

a main assembly;

an operable member openable relative to said main assembly;

an intermediary transfer member for carrying a transferred toner image;

a cleaning member for removing toner remaining on said intermediary transfer member;

a transfer member for transferring the toner image onto a sheet;

a fixing member for fixing the toner image, transferred by said transfer member, on the sheet;

a discharging member for discharging the sheet, on which the toner image is fixed by said fixing member, from said main assembly, wherein when the sheet is not discharged by said discharging member and remains at a periphery of said intermediary transfer member in said main assembly, the sheet is removable from a space, at the periphery of said intermediary transfer member, formed by opening said openable member; and a spacer unit capable of moving said cleaning member toward and away from said intermediary transfer member, wherein said spacer unit brings said cleaning member into contact with said intermediary transfer member in a state in which said openable member is closed and image formation is effected, and moves said cleaning member away from said image bearing member in interrelation with an opening operation of said openable member.

2. An apparatus according to claim 1, wherein said intermediary transfer member is detachably mountable to said main assembly, and wherein said image forming apparatus further comprises a locking unit for locking said intermediary transfer member at an image forming position, and locking by said locking unit is released by opening said openable member.

3. An apparatus according to claim 2, wherein said spacer unit also functions as said locking unit.

4. An apparatus according to claim 1, wherein said spacer unit includes a cam and moves said cleaning member from said intermediary transfer member by operating the cam in interrelation with an opening and closing operation of said openable member.

5. An apparatus according to claim 4, wherein the cam is rotatably supported about a rotation shaft of said intermediary transfer member and is rotated independently of said intermediary transfer member.

6. An apparatus according to claim 1, further comprising drive transmitting means for connecting said openable member and said spacer unit, wherein said drive transmitting means transmits a driving force for opening and closing said openable member to said spacer unit so as to move said cleaning member away from said intermediary transfer member.

7. An apparatus according to claim 1, further comprising a driving source for driving said spacer unit and a detecting unit for detecting that said openable member is opened, wherein said driving unit drives said spacer unit when said detecting unit detects that said openable member is opened.

8. An apparatus according to claim 1, wherein said intermediary transfer member comprises an intermediary transfer drum rotatable about a rotation shaft thereof, wherein said apparatus further comprises a cartridge tray including plurality of photosensitive members rotatable relative to said intermediary transfer drum and comprises a plurality of developing units each including developing means for developing the toner image on an associated photosensitive member of said cartridge tray, and wherein said plurality of developing units are detachably mountable to said cartridge tray.

9. An apparatus according to claim 8, wherein said plurality of developing units are detachably mountable by rotationally moving said cartridge tray to the space formed by opening said openable member.

* * * * *